US009158321B2

(12) United States Patent
Ting

(10) Patent No.: US 9,158,321 B2
(45) Date of Patent: Oct. 13, 2015

(54) LINEAR CURRENT REGULATOR

(71) Applicant: ANALOG VISION TECHNOLOGY INC., New Taipei (TW)

(72) Inventor: Ming-Chiang Ting, Hsinchu (TW)

(73) Assignee: GREEN SOLUTION TECHNOLOGY CO., LTD., Taipei County (TW)

( * ) Notice: Subject to any disclaimer, the term of this patent is extended or adjusted under 35 U.S.C. 154(b) by 266 days.

(21) Appl. No.: 13/662,378

(22) Filed: Oct. 26, 2012

(65) Prior Publication Data

US 2014/0002040 A1 Jan. 2, 2014

(30) Foreign Application Priority Data

Jun. 27, 2012 (TW) ..... 101122977 A

(51) Int. Cl.
*G05F 3/16* (2006.01)
*G05F 1/56* (2006.01)

(52) U.S. Cl.
CPC .. *G05F 1/561* (2013.01); *G05F 3/16* (2013.01)

(58) Field of Classification Search
CPC ..... H02M 2001/0003; G05F 1/561; G05F 1/652; G05F 1/656
USPC ..... 323/311–316, 299
See application file for complete search history.

(56) References Cited

U.S. PATENT DOCUMENTS

| | | | | | |
|---|---|---|---|---|---|
| 3,697,871 | A | * | 10/1972 | MacMullan | 324/99 R |
| 3,711,850 | A | * | 1/1973 | Kelly | 341/167 |
| 4,399,399 | A | * | 8/1983 | Joseph | 323/315 |
| 5,210,041 | A | * | 5/1993 | Kobayashi et al. | 438/7 |
| 5,341,087 | A | * | 8/1994 | Van Leeuwen | 323/315 |
| 5,570,060 | A | * | 10/1996 | Edwards | 327/541 |
| 2012/0038343 | A1 | * | 2/2012 | Takagi et al. | 323/299 |

FOREIGN PATENT DOCUMENTS

| | | | |
|---|---|---|---|
| CN | 101025637 | A | 8/2007 |
| CN | 101089770 | A | 12/2007 |

* cited by examiner

*Primary Examiner* — Harry Behm
*Assistant Examiner* — Peter Novak
(74) *Attorney, Agent, or Firm* — Li & Cai Intellectual Property (USA) Office

(57) ABSTRACT

A linear current regulator is disclosed herein, which comprises a first amplifier, a current converter unit, a first resistor, a reference current source, a regulating unit, and a reference voltage circuit. The current converter unit converts voltage level of an non-inverting input end of the first amplifier into a regulated current and outputs it. The first resistor is coupled to an inverting input end and an output end of the first amplifier. The reference current source is coupled to the inverting input end of the first amplifier and the first resistor. The regulating unit is coupled to the reference current source and outputs a current signal for adjusting a reference current of the reference current source. The reference voltage circuit has at least two input ends. The reference voltage circuit has one input end coupled to a reference voltage and another input end coupled to the first amplifier.

9 Claims, 4 Drawing Sheets

LINEAR CURRENT REGULATOR

BACKGROUND

1. Technical Field

The present disclosure relates to current regulators; in particular, to a linear current regulator.

2. Description of Related Art

Due to the energy efficiency and energy saving requirements, LED is broadly used in many fields. For instance, electric products, household appliance, cars, traffic lights, and panels which using point light source or surface light source have already become the LED application market. The function of controlling the output brightness of LED is commonly configured to the driving circuit, no matter LED is driven by boost, buck, boost/buck or linearly regulating voltage circuit. Currently, the main controlling methods of LED brightness are digital dimming and analog dimming method.

The digital dimming makes the driving current switch between a zero to a predetermine value. The PWM (pulse with modulation) is a very common method utilized to set circle and duty cycles. However, the issues of electromagnetic compatibility (EMC) and electromagnetic interference (EMI) always occur to cause the potential frequency problem.

Since the output current variation of the LED driver is proportional to the brightness thereof, the analog dimming which linearly regulates LED is easily implemented. Therefore, it's an important topic in this technical filed to find a high linear current regulator for regulating the brightness of LED.

SUMMARY

An exemplary embodiment of the present disclosure provides a linear current regulator. The linear current regulator determines a voltage level of one of the input ends of the first amplifier via regulating the reference current of the reference current source. Then, the voltage level is converted to a regulating current by a voltage-to-current converter which outputs the regulating current to implement the regulating current function. The regulating current can be used to control the brightness of the LED.

According to an exemplary embodiment of the present disclosure, a linear current regulator may adjust the current value of the reference current source via the variable resistor of the regulating unit. As the coefficient of the current regulator is a predetermined value, the resistance of the variable resistor is linear relation with above-mentioned voltage level. That is, the regulating current can be linearly controlled by adjusting the resistance of the variable resistor. Except to apply the regulating current in the LED, the regulating current also can be applied in the charger as the charging current. Through regulating the resistances of the variable resistor to fine tune the charging current, inconvenience and time-consuming of changing the hardware can be improved.

An exemplary embodiment of the present disclosure provides a linear current regulator of the present disclosure is provided. The linear current regulator comprises a first amplifier, a current converter unit, a first resistor, a reference current source, a regulating unit and a reference voltage circuit. The first amplifier has an inverting input end, a non-inverting input end and an output end. The current converter unit converts voltage level of the non-inverting input end into a regulated current and outputs it. The first resistor is coupled to the inverting input end and the output end of the first amplifier. The reference current source is coupled to the inverting input end of the first amplifier and the first resistor. The regulating unit is coupled to the reference current source and outputs a current signal for adjusting a reference current of the reference current source. The reference voltage circuit has two input ends. The reference voltage circuit has one input end coupled to a reference voltage and the other input end coupled to the first amplifier.

In order to further appreciate the characteristic and technical contents of the instant disclosure, references are hereunder made to the detailed descriptions and appended drawings in connection with the instant disclosure. However, the appended drawings are merely shown for exemplary purpose rather being used to restrict the scope of the instant disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
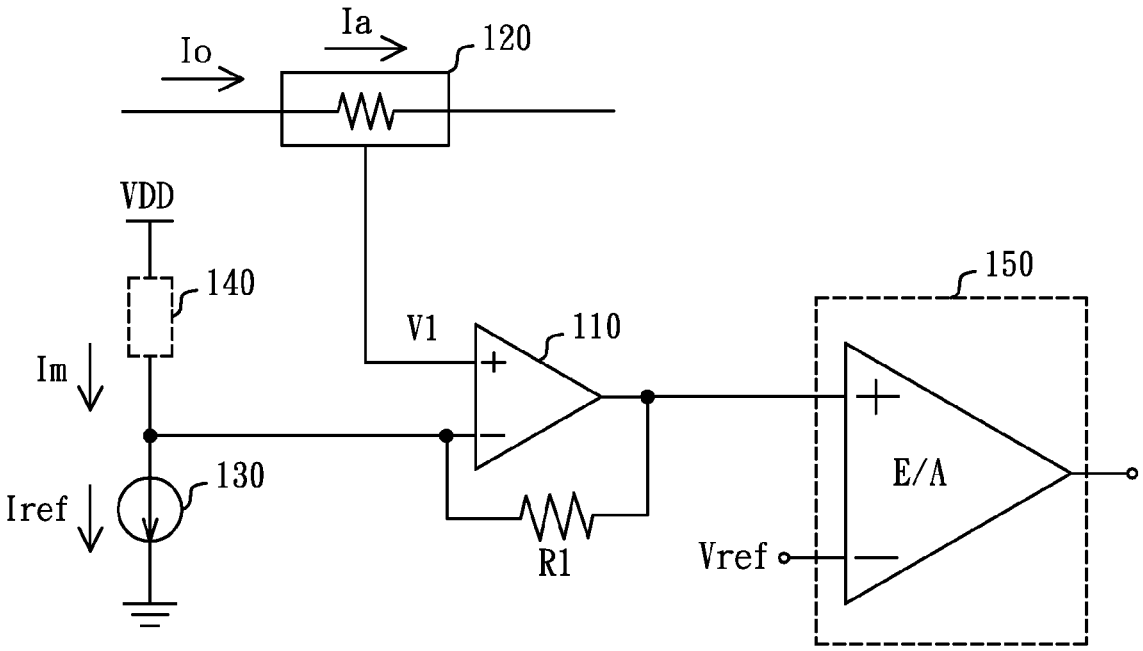
FIG. 1 shows a circuit diagram illustrating a linear current regulator according to one embodiment of the present disclosure.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

As used in the description herein and throughout the claims that follow, the meaning of "a", "an", and "the" includes reference to the plural unless the context clearly dictates otherwise.

FIG. 1 is a circuit diagram illustrating a linear current regulator according to one embodiment of the present disclosure. The linear current regulator comprises a first amplifier 110, a voltage-to-current converter 120, a first resistor R1, a reference current source 130, a regulating unit 140 and a reference voltage circuit 150.

The above-mentioned first amplifier 110 has an inverting input end, a non-inverting input end, and an output end. The voltage-to-current converter 120 converts a voltage level V1 of the non-inverting input end of the first amplifier 110 into a regulating current Ia and outputs the regulating current Ia. The first resistor R1 is coupled to the node between the inverting input end and the output end of the first amplifier 110. The reference current source 130 is coupled to the node between the inverting input end of the first amplifier 110 and the first resistor R1. The regulating unit 140 is coupled to the reference current source 130 and outputs a current signal Im for regulating a reference current Iref of the reference current source 130.

The reference voltage circuit 150 having two input ends. One of the input ends of the reference voltage circuit 150 receives a reference voltage Vref, and the other is coupled to the output end of the first amplifier 110. In the present embodiment, an error amplifier or a comparator is as one example of the reference voltage circuit 150 and the present disclosure is not limited thereto. The reference voltage circuit 150 may be used an amplifier and a similar circuit.

The reference voltage circuit 150 is utilized to make the electric potential of one end which is coupled to the first amplifier 110 thereof is equal to that which is the electric potential of the reference voltage Vref of the other end thereof. The output end of the reference voltage circuit 150 outputs a voltage signal to a power stage circuit (not shown in the FIG. 1).

According to the above-mentioned current regulator, the voltage level V1 of the non-inverting input end of the first amplifier 110 can be calculated as function (1):

$$V1=(Im-Iref)*R1+Vref \qquad \text{function(1)}$$

Wherein V1 is the voltage level of the non-inverting input end of the first amplifier 110; Im is the current signal; Iref is the reference current of the reference current source 130; R1 is the first resistor; Vref is the reference voltage.

According to function (1), the voltage level V1 linearly varied with the current signal Im. The current signal Im is used to regulate the reference current Iref of the reference current source 130. The voltage level V1 of the non-inverting input end of the first amplifier 110 is determined by regulating the reference current Iref. Then the voltage-to-current converter 120 converts the voltage level V1 into the regulating current Ia and outputs the regulating current Ia. The regulating current Ia can be utilized to regulate the output current To of electrical devices. For example, the regulating current Ia can be used to regulate the current flowing through LED and the brightness of LED can be controlled. Moreover, the regulating current Ia can fine tune the charging current of a charger for controlling the charging time of the charger. Wherein, the voltage-to-current converter 120 may be implemented by a resistor circuit.

Figure 2:
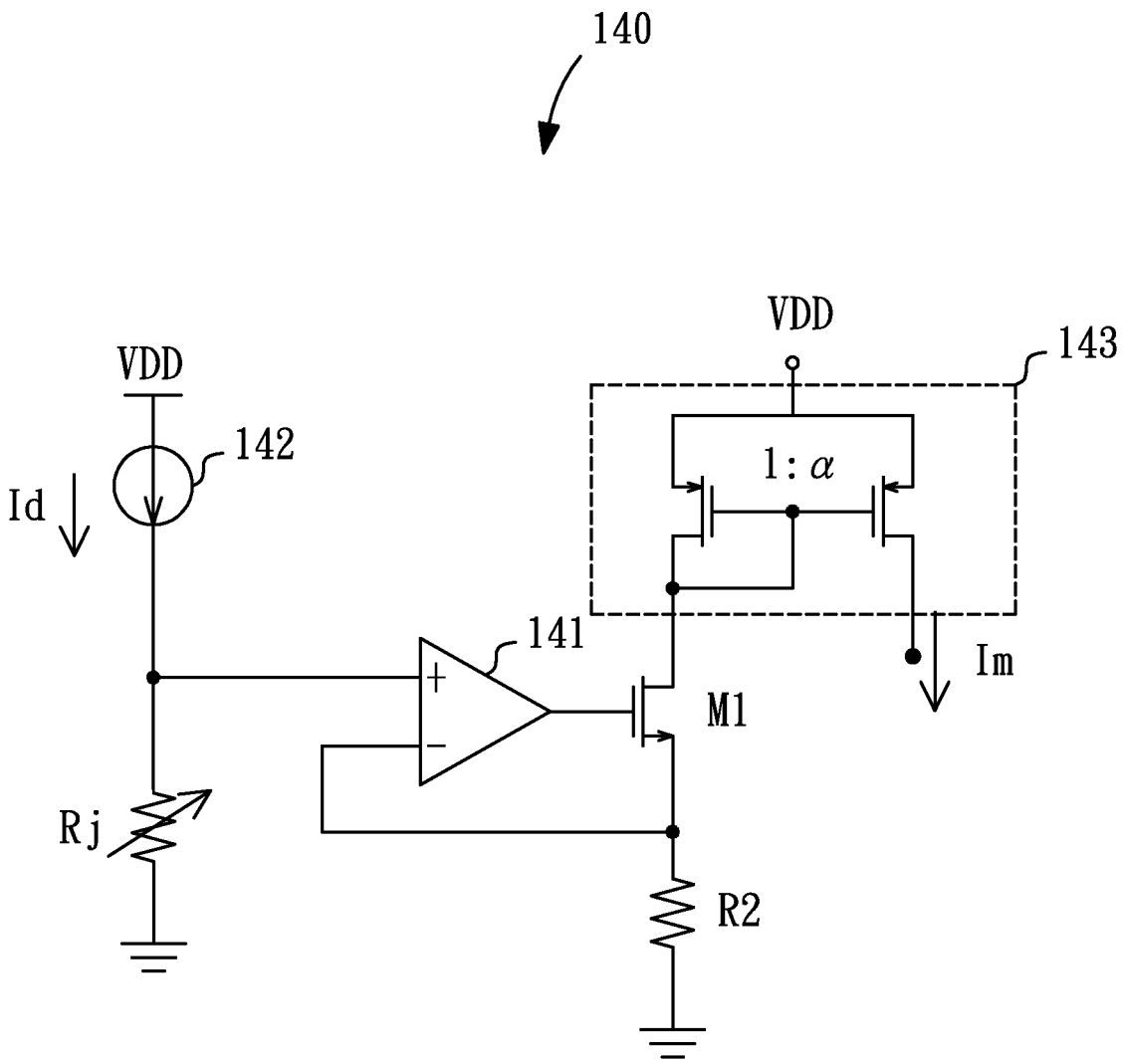
FIG. 2 shows a circuit diagram illustrating a regulating unit of the linear current regulator according to one embodiment of the present disclosure.

FIG. 2 is a circuit diagram illustrating a regulating unit of the linear current regulator according to one embodiment of the present disclosure. As sown in FIG. 2, the regulating unit 140 comprises a second amplifier 141, a constant current source 142, a variable resistor Rj, a first switch M1, and a first current mirror 143.

The second amplifier 141 has an inverting input end, a non-inverting input end and an output end. The constant current source 142 is coupled to the non-inverting input end of the second amplifier 141 and outputs a constant current Id. The variable resistor Rj is coupled to the constant current source 142. The first switch M1 has a first end, a second end and a third end. The second end of the first switch M1 is coupled to the output end of the second amplifier 141. The third end of the first switch M1 is coupled to the node between the inverting input end of the second amplifier 141 and a second resistor R2. The first current mirror 143 with current gain factor α is coupled to the first end of the first switch M1 and outputs the current signal Im.

According to the regulating unit 140, the current signal Im can be calculated as function (2):

$$Im=\alpha*Id*Rj/R2 \qquad \text{function(2)}$$

Wherein Im is the output current signal of the first current mirror 143; α is the current gain factor of the first current mirror 143; Id is the constant current outputted from the constant current source 142; Rj is the variable resistor; R2 is the second resistor.

According to function (2), the current signal Im is directly proportional to the constant current Id outputted from the constant current source 142. As regulate the resistance of the variable resistor Rj, the current signal Im is varied. Consequently, the reference current Iref of the reference current source 130 can be regulated (reference to the FIG. 1).

The constant current source 142 may be configured in an integrated circuit (IC) chip, and the variable resistor Rj is placed outside the IC chip. So that, through regulating the resistance of the variable resistor Rj outside the IC, the current value of the IC can be controlled. Accordingly, the inconvenience and time-consuming of changing the hardware can be improvement.

Figure 3:
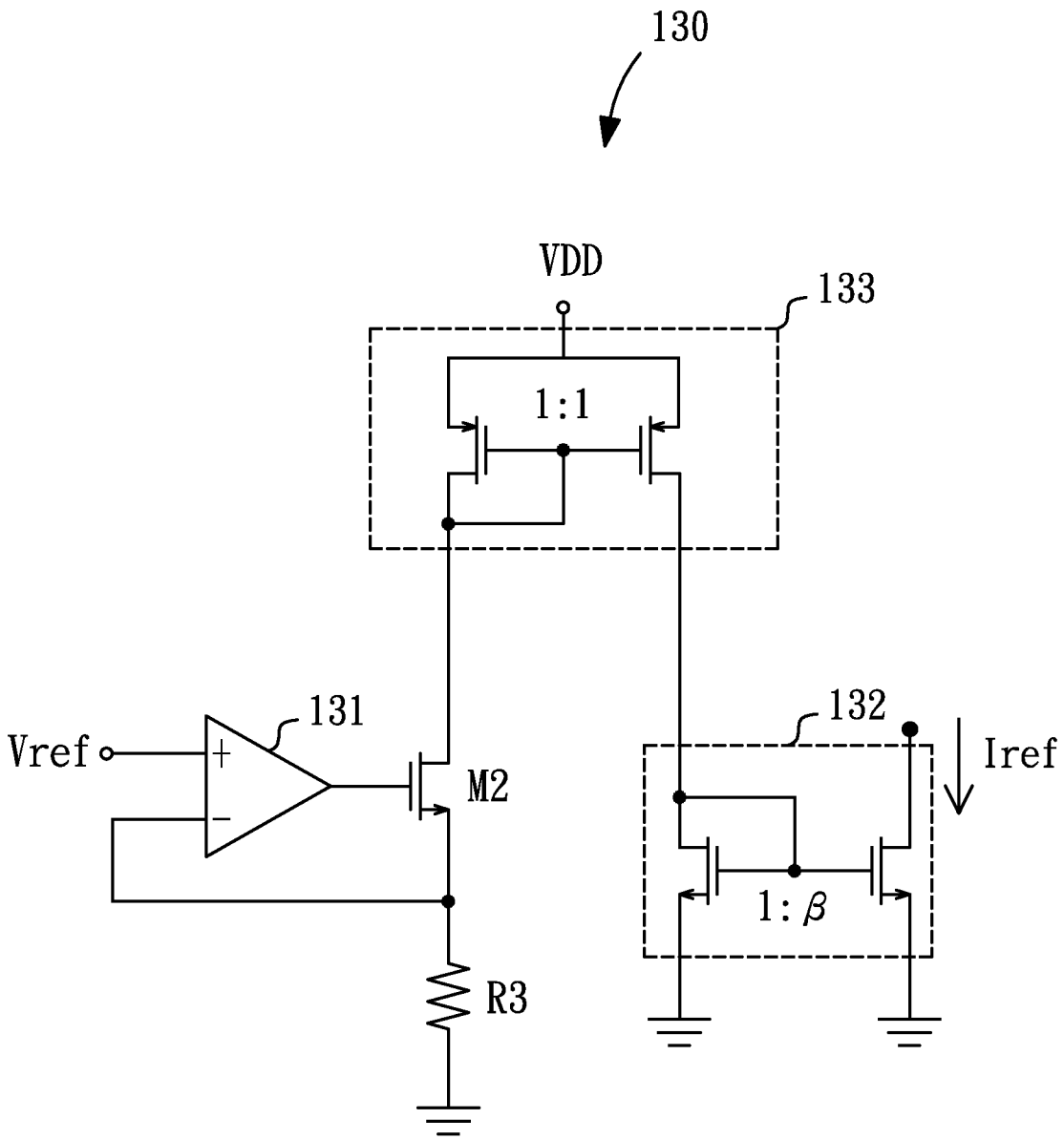
FIG. 3 shows a circuit diagram illustrating a reference current source of the linear current regulator according to one embodiment of the present disclosure.

FIG. 3 is a circuit diagram illustrating a reference current source of the linear current regulator according to one embodiment of the present disclosure. As shown in FIG. 3, the reference current source 130 comprises a third amplifier 131, a second switch M2, a second current mirror 132 and a third current mirror 133. The third amplifier 131 has an inverting input end, a non-inverting input end and an output end. The non-inverting input end of the third amplifier 131 is received a reference voltage Vref. The second switch M2 has a first end, a second end and a third end. The second end of the second switch M2 is coupled to the output end of the third amplifier 131. The first end of the second switch M2 is coupled to the one end of the third current mirror 133. The third end of the second switch M2 is coupled to the node between the inverting input end of the third amplifier 131 and the third resistor R3. The second current mirror 132 with current gain factor β is coupled to the other end of the third current mirror 133 and outputs the reference current Iref.

According to the reference current source 130, the reference current Iref can be calculated as the function (3):

$$Iref=\beta*Vref/R3 \qquad \text{function(3)}$$

Wherein Iref is the reference current outputted from the reference current source 130; β is the current gain factor of the second current mirror 132; Vref is the reference voltage; R3 is the third resistor.

According to function (3), the reference current source 130 generates the reference current Iref according to the reference voltage Vref. The reference current Iref is directly proportional to the reference voltage Vref. As the requirement of the reference current Iref is more, the pick of the reference voltage Vref is bigger.

According to function (1)~function (3), as R2=R3 and α=β, the function (4) can be calculated as following:

$$V1=(IdRj-Vref)R1\alpha/R2+Vref \qquad \text{function(4)}$$

As R1*α=R2 or R1=R2, and α=1, the function (5) can be calculated as following:

$$V1=IdRj \qquad (5)$$

Wherein V1 is the voltage level of the non-inverting input end of the first amplifier 110; Id is the constant current outputted from the constant current source 142; Rj is the variable resistor; β is current gain factor of the second current mirror 132; a is current gain factor of the first current mirror 143; R2 is second resistor; R3 is third resistor.

Figure 4:
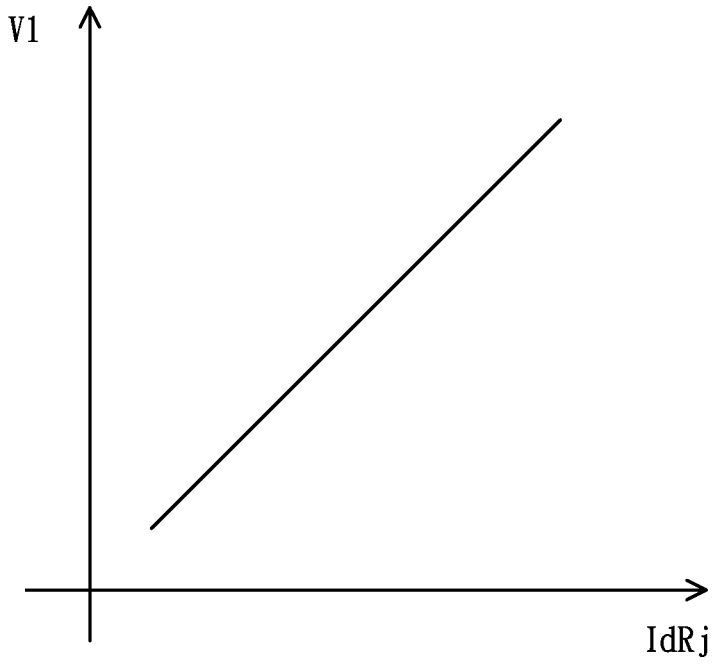
FIG. 4 shows a diagram illustrating the high linear regulated voltage level of the linear current regulator according to one embodiment of present disclosure.

According to function (5), the voltage level V1 of the non-inverting input end of the first amplifier 110 is directly proportional to the variable resistor Rj, as shown in FIG. 4. FIG. 4 is a diagram illustrating the high linear regulated voltage level of the linear current regulator according to one embodiment of present disclosure. Through regulating the resistance of the variable resistor Rj, the voltage level V1 can be received. Then, the voltage-to-current converter 120 converts the voltage level V1 into the regulating current Ia and outputs the regulating current Ia, so that the high linear regulating current Ia can be obtained. The regulating current Ia can be utilized to control the brightness of the LED and regulate the current for charging the charger.

The above-mentioned is only the embodiment of the present invention, which can't be used to restrict the scope of the present invention.

What is claimed is:

1. A linear current regulator, comprising:

a first amplifier, having an inverting input end, a non-inverting input end, and an output end;

a voltage-to-current converter, for converting a voltage level of the non-inverting input end of the first amplifier into a regulating current and outputting the regulating current;

a first resistor, coupled between the inverting input end and the output end of the first amplifier;

a reference current source, coupled to a node between the inverting input end of the first amplifier and the first resistor;

a regulating unit, coupled to the reference current source, for outputting a current signal so as to regulate a reference current of the reference current source; and a reference voltage circuit, having at least two input ends, wherein one of the input ends of the reference voltage circuit receives a reference voltage and another of the input ends of the reference voltage circuit is coupled to the output end of the first amplifier;

wherein the regulating unit has a variable resistor for regulating the reference current and the voltage level of the non-inverting input end of the first amplifier is directly proportional to the variable resistor;

wherein the voltage level of the non-inverting input end of the first amplifier is represented as $$V1=(Im-Iref)*R1+Vref,$$

wherein V1 is the voltage level of the non-inverting input end of the first amplifier, Im is the current signal, Iref is the reference current, R1 is the first resistor and the Vref is the reference voltage.

2. The linear current regulator of claim 1, wherein the reference voltage circuit is an amplifier and the reference voltage circuit further comprises an output end for outputting a voltage signal to a power stage circuit.

3. The linear current regulator according to claim 1, wherein the reference voltage circuit is a comparator and the reference voltage circuit further comprises an output end for outputting a voltage signal to a power stage circuit.

4. The linear current regulator of claim 1, wherein the reference current source generates the reference current according to the reference voltage.

5. The linear current regulator of claim 1, wherein the regulating unit further comprises:

a second amplifier, having an inverting input end, a non-inverting input end, and an output end;

a constant current source, coupled to a node between the variable resistor and the non-inverting input end of the second amplifier, for outputting a constant current;

a first switch, having a first end, a second end, and a third end, wherein the second end of the first switch is coupled to the output end of the second amplifier and the third end of the of the first switch is coupled to a node between the inverting input end of the second amplifier and a second resistor; and a first current mirror, coupled to the first end of the first switch, for outputting the current signal, wherein the current signal is directly proportional to the constant current.

6. The linear current regulator of claim 5, wherein the constant current source is configured in an integrated circuit (IC) chip, and the variable resistor is placed outside the IC chip.

7. The linear current regulator of claim 5, wherein the reference current source comprises:

a third amplifier, having an inverting input end, a non-inverting input end, and an output end, wherein the non-inverting input end of the third amplifier receives the reference voltage;

a second switch, having a first end, a second end, and a third end, wherein the second end of the second switch is coupled to the output end of the third amplifier; the first end of the second switch is coupled to one end of a third current mirror; the third end of the second switch is coupled to a node between the inverting input end of the third amplifier and a third resistor; and a second current mirror, coupled to another end of the third current mirror, wherein the reference current is directly proportional to the reference voltage.

8. The linear current regulator of claim 7, the resistance of the second resistor is substantially equal to the resistance of the third resistor.

9. The linear current regulator of claim 8, wherein the voltage level of the non-inverting input end of the first amplifier is substantially equal to the product of the resistance of the variable resistor and the constant current.

* * * * *